US007331477B2

(12) United States Patent
Schulte et al.

(10) Patent No.: US 7,331,477 B2
(45) Date of Patent: Feb. 19, 2008

(54) METHOD AND DEVICE FOR DETERMINING A SWINGING MOTION OF A LOAD SUSPENDED FROM A LIFTING GEAR

(75) Inventors: Peter Schulte, Markt Erlbach (DE); Peter Maurer, Stein (DE); Ingbert Strebel, Baiersdorf (DE)

(73) Assignee: Siemens Aktiengesellschaft, München (DE)

( * ) Notice: Subject to any disclaimer, the term of this patent is extended or adjusted under 35 U.S.C. 154(b) by 311 days.

(21) Appl. No.: 11/093,028

(22) Filed: Mar. 29, 2005

(65) Prior Publication Data

US 2005/0232626 A1 Oct. 20, 2005

Related U.S. Application Data

(63) Continuation of application No. PCT/DE03/03200, filed on Sep. 25, 2003.

(30) Foreign Application Priority Data

Sep. 30, 2002 (DE) ..... 102 45 889

(51) Int. Cl.
*B66C 13/46* (2006.01)

(52) U.S. Cl. ..... 212/270; 212/273; 212/275; 356/139.1; 356/614

(58) Field of Classification Search ..... 212/270, 212/273, 275; 356/139.1, 614
See application file for complete search history.

(56) References Cited

U.S. PATENT DOCUMENTS

| | | | | |
|---|---|---|---|---|
| 5,491,549 | A * | 2/1996 | Wichner et al. | 356/141.2 |
| 6,351,720 | B1 * | 2/2002 | Hoshina et al. | 702/154 |
| 6,644,485 | B2 * | 11/2003 | Uchida et al. | 212/270 |

FOREIGN PATENT DOCUMENTS

| | | | |
|---|---|---|---|
| DE | 20 53 590 | A | 5/1972 |
| DE | 38 42 918 | A1 | 6/1990 |
| DE | 43 39 893 | A1 | 5/1994 |
| DE | 41 90 587 | | 5/1996 |
| DE | 198 26 695 | A1 | 12/1999 |
| EP | 0 979 796 | A | 2/2000 |
| JP | 07 309 582 | A * | 11/1995 |
| JP | 07 309582 | A | 11/1995 |
| JP | 2000-63076 | A * | 2/2000 |
| WO | WO 92/19526 | A | 11/1992 |

* cited by examiner

*Primary Examiner*—Thomas J Brahan
(74) *Attorney, Agent, or Firm*—Henry M. Feiereisen; Ursula B. Day

(57) ABSTRACT

A method and a device for determining the rotary oscillation of a load suspended from a lifting gear are disclosed. The lifting gear includes a trolley equipped with a camera that can be oriented towards the load. The load includes at least two spaced apart markers, with one marker located on or near the axis of rotation, which extends in the lifting direction. A rotary oscillation of the load can be determined from the position of two markers, whereby at least one marker is recorded by the camera and its position is determined. At least at certain points in time, the rotary oscillation is determined by including a virtual position of a marker.

13 Claims, 5 Drawing Sheets

METHOD AND DEVICE FOR DETERMINING A SWINGING MOTION OF A LOAD SUSPENDED FROM A LIFTING GEAR

CROSS-REFERENCES TO RELATED APPLICATIONS

This application is a continuation of prior filed copending PCT International application No. PCT/DE2003/003200, filed Sep. 25, 2003, which designated the United States and on which priority is claimed under 35 U.S.C. §120, and which claims the priority of German Patent Application, Serial No. 102 45 889.8, filed Sept. 30, 2002, pursuant to 35 U.S.C. 119(a)-(d).

BACKGROUND OF THE INVENTION

The present invention relates, in general, to a method and a device for determining a rotary oscillation of a load of a lifting gear.

Nothing in the following discussion of the state of the art is to be construed as an admission of prior art.

When a load, for example a container, is lifted by cables, a rotation and/or wobble motion can occur, also referred to as skew. Such skew motions, which can be viewed as a certain type of rotary oscillation, are currently captured by a system with two cameras that determine the position of the load. In the following, the term "rotary oscillation" will be used in a generic sense and is used synonymously and interchangeably with rotation, wobble and/or skew motion. FIG. 3 shows a system with two cameras 8, whereby an active light source 16, for example an infrared light beam, is associated with each camera 8. Each camera 8 can capture an image field 11 with markers 9, 10. The motion during a rotary oscillation can be determined by measuring the position changes of the markers 9, 10 about a center of mass 17 of a load. The markers 9, 10 are differentiated on the load and/or the load-carrying member by applying the marker 9 to the load at an offset at a right angle relative to the marker 10. A processor evaluates the images recorded by the two cameras 8.

The use of two cameras is very expensive, so that the use of a single camera is proposed. However, current technology makes it difficult to use only one camera because the available computer power limits the time for evaluating the images recorded by the camera, so that the actual position values of the load cannot be updated and supplied fast enough to a control system for controlling the rotary oscillation.

German Pat. No. DE 4190587 C1 describes a system with only a single camera. A unit evaluates the image acquired by the camera to determine the position of a load. The image recorded by the camera has at least two markers that are used for computing the position. A system of this type suffers shortcomings because of the inability to adequately detect a rotation and/or wobble motion, also referred to as skew, of a load lifted with cables, for example a container since the image acquisition time for determining the position is very long. Measurements of the actual position values of the load are therefore too infrequent so as to be useful in a controller to counteract the skew. The limited computer power typically prevents acquisition of a greater number of actual values of the position of the load.

It would therefore be desirable and advantageous to provide an improved method and device that can cost-effectively record a rotation and/or wobble motion of a load suspended from a lifting gear.

SUMMARY OF THE INVENTION

According to one aspect of the invention, a method for determining a rotary oscillation of a load suspended from a lifting gear having a trolley equipped with a camera, includes the steps of applying at least two spaced-apart markers to a load, with a first one of the markers positioned on an axis of the rotary oscillation extending in a lifting direction, orienting the camera in a direction toward the load, recording with the camera a second one of the markers which is not located on the axis of the rotary oscillation to thereby determine a position of the second marker, and identifying a rotary oscillation of the load from the positions of the first and second markers.

According to another aspect of the invention, a device for determining a rotary oscillation of a load suspended from a lifting gear, includes a camera recording positions of markers attached to a load, with one of the markers located on an axis of the rotary oscillation which extends in a lifting direction of the load, and an interpolator connected to the camera for data transfer for interpolating between recorded positions of the one marker.

According to yet another aspect of the invention, a device for determining a rotary oscillation of a load suspended from a lifting gear includes a camera attached to a trolley of a lifting gear and constructed for alignment in a direction of the load, said camera recording and processing at least two markers attached to the load, and an image identification unit linked by data connection to the camera.

The markers reflect and/or actively send light into the camera with the help of at least one light source. One of marker is located in the axis of the rotary oscillation of the load, wherein the oscillation axis extends in the lifting direction. The load is, for example, a useful load and/or a useful load which is received by a load-carrying member. The useful load is, for example, a container and the load-carrying member is, for example, a spreader. A rotary oscillation of the load is recognized from the position of two markers, whereby at least one marker is recorded by the camera and its position is determined. A virtual position is computed for the marker that is located near the axis of the rotary oscillation.

In this way, the image area of interest in the image recorded by the camera, which is evaluated to determine the position of the load, is advantageously reduced to a single marker as long as the virtual position of the second marker is known. In this way, a greater number of actual values for the position of the load can be determined. After at least one or several positions of the marker that is not located in the axis of the rotary oscillation have been recorded, the virtual position of the marker located near the axis of the rotary oscillation is corrected by an image processing unit to match the actual position. Accordingly, the position of the load can be measured by evaluating a smaller number of picture elements, for example from a digital camera, than with conventional methods, so that measurements can be performed more frequently. The rotary oscillation of the load can also be determined more accurately due to the improved control accuracy for settling the rotary oscillation, because according to the invention a marker is located in a region which exhibits a smaller excursion caused by the motion than another marker, such as a region near the center of the rotary oscillation, which in the present example is parallel to the lifting direction of the load.

A rotation angle and/or a position of the load can be computed by acquiring the position of the markers, which can be either real or virtual.

The computing time for evaluating the image points can be reduced by interpolating the position of the marker located on the axis of the rotary oscillation between two recordings taken with the camera. The evaluation of the image points can be optimized by evaluating only those image points where a marker is expected. Interpolations can be performed in many ways, for example, by using a staircase function or a polynomial interpolation.

According to another feature of the present invention, the camera can record a first image with at least two markers and identify the at least two markers in the image and evaluate their position, thereby identifying a marker that is located on the axis of the rotary oscillation. The camera can then record a second image with at least two markers and evaluate the position of that marker in the second image that is different from the marker previously located on the axis of the rotary oscillation. A virtual position of the position of the marker on the axis extending in the lifting direction can be used to compute the position of the load.

According to yet another feature of the present invention, the second image can be recorded with at least twice, and even ten times, the frequency as the first image.

According to another feature of the present invention, one of the at least two markers can be located on an axis of the rotary oscillation, with the axis extending in a lifting direction of the load. This marker near the axis does not change its position during a rotation oscillation about this axis to the same extent as other markers located away from the axis. Accordingly, the position of the marker near the axis is easier to interpolate than the position of other markers. Accordingly, a virtual—interpolated—position can be defined for the position of the load or for determining a rotary oscillation of a load.

According to another feature of the present invention, the at least two markers can be positioned on the load at arbitrarily selected positions. Accordingly, loads can be easily exchanged without having to repeatedly determine the exact position of a load or a rotary oscillation.

Loads can also be easily exchanged by providing a means for determining the axis of the rotary oscillation in the lifting direction for the load rotation. For example, if the rotation axis of a skew motion is located in the center of mass, then a light beam can be directed from the camera to a point on the load that represents the center of mass.

Advantageously, a virtual position of the virtually computed position marker can be determined by an algorithm for rotary oscillation that is already used in the lifting gear. For example, the skew angle can be easily determined by using a single camera system with a light source emitting an infrared light beam and markers then can advantageously also emit infrared light.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
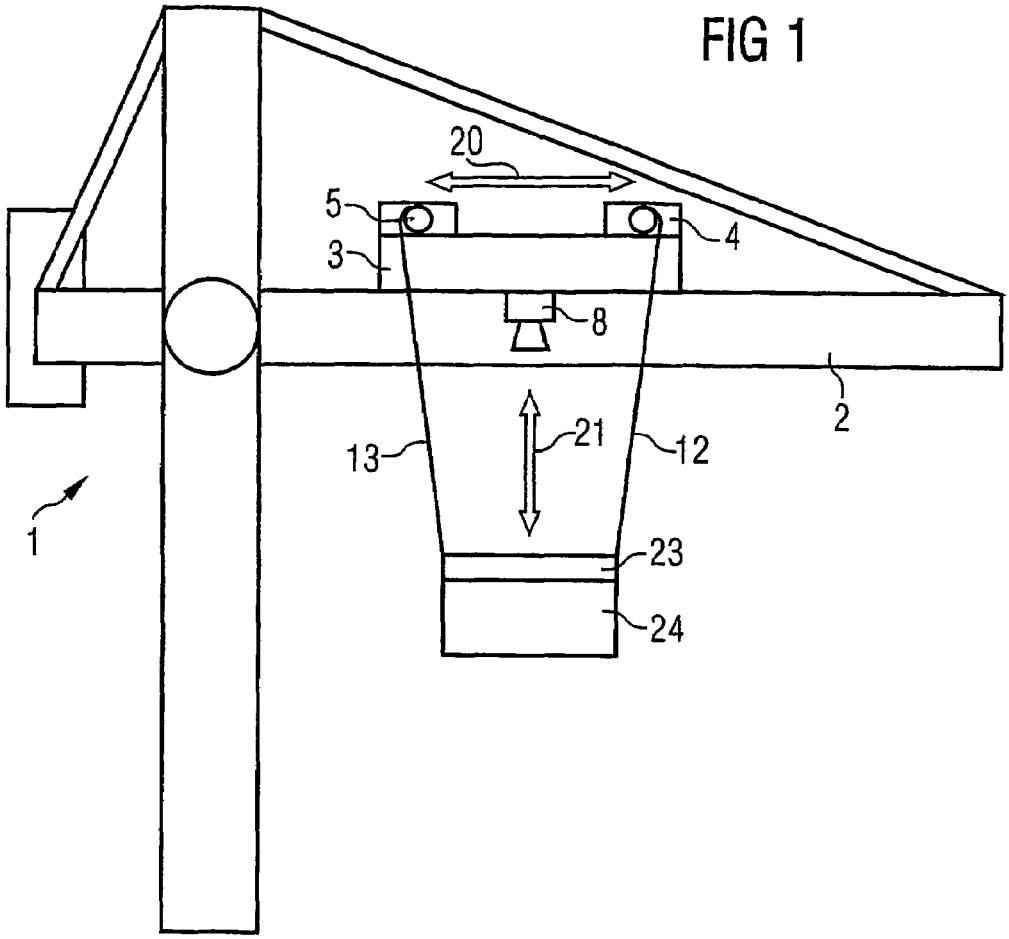
FIG. 1 shows a schematic diagram of a crane with a lifting gear.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

This is one of three applications, all filed on the same day. These applications deal with related inventions. They are commonly owned and have same or different inventive entities. These applications are unique, but incorporate the others by reference. Accordingly, the following U.S. patent application is hereby expressly incorporated by reference: "METHOD AND DEVICE FOR RECOGNITION OF A LOAD ON A LIFTING GEAR" by co-inventors Peter Maurer, Peter Schulte, and Ingbert Strebel, and "METHOD AND DEVICE FOR MAINTAINING A POSITION OF A LOAD SUSPENDED FROM A LIFTING GEAR", by co-inventors Peter Maurer and Peter Schulte.

Turning now to the drawing, and in particular to FIG. 1, there is shown a side view a schematic illustration of a crane generally designated by reference numeral 1. The crane 1 includes a boom 2 and a trolley 3 movable along the boom 2 in a travel direction, as indicated by a double arrow 20. The trolley 3 includes a hoist mechanism for lifting a load 24 in a direction, as indicated by a double arrow 21. The hoist mechanism has four lifting units 4, with each of the lifting units 4 equipped with a cable drum 5. In the illustration of FIG. 1, only two of the four lifting units 4 are visible, with the other lifting units 4 obscured from view. The crane 1 represents an exemplary lifting gear, which is equipped with a camera 8 for determining a position of the load 24 or a position of a load-carrying member 23, for example a spreader for a container. A determination of this position enables also a determination of a rotary or skewing motion of the load 24 or the load-carrying member 23. The load 24 and/or the load-carrying member 23 include hereby markers for position identification by the camera 8.

Figure 2:
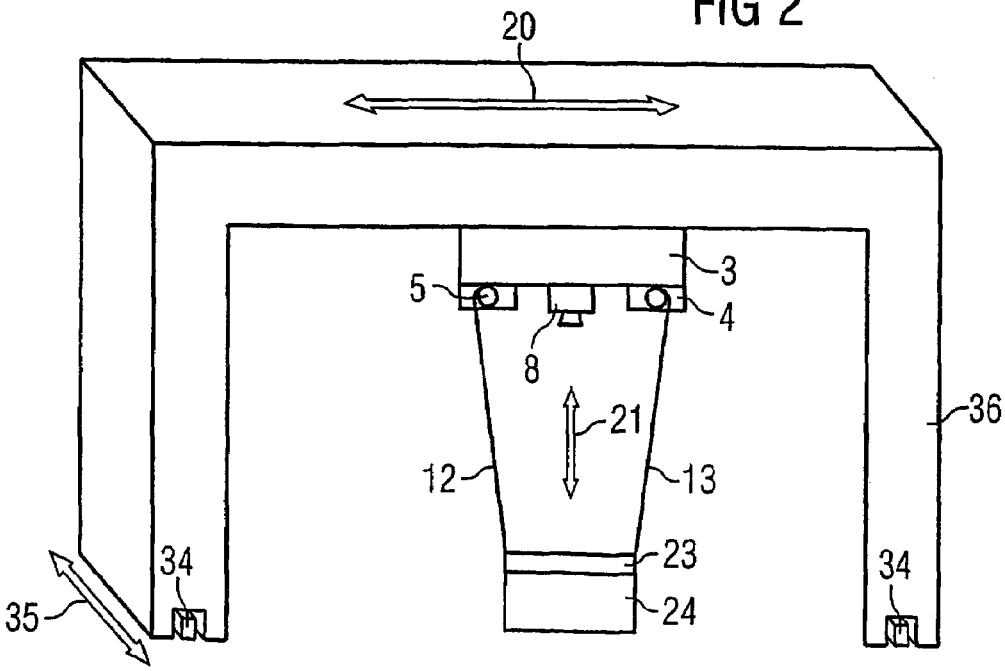
FIG. 2 shows a schematic diagram of a container bridge with a lifting gear.
Figure 3:
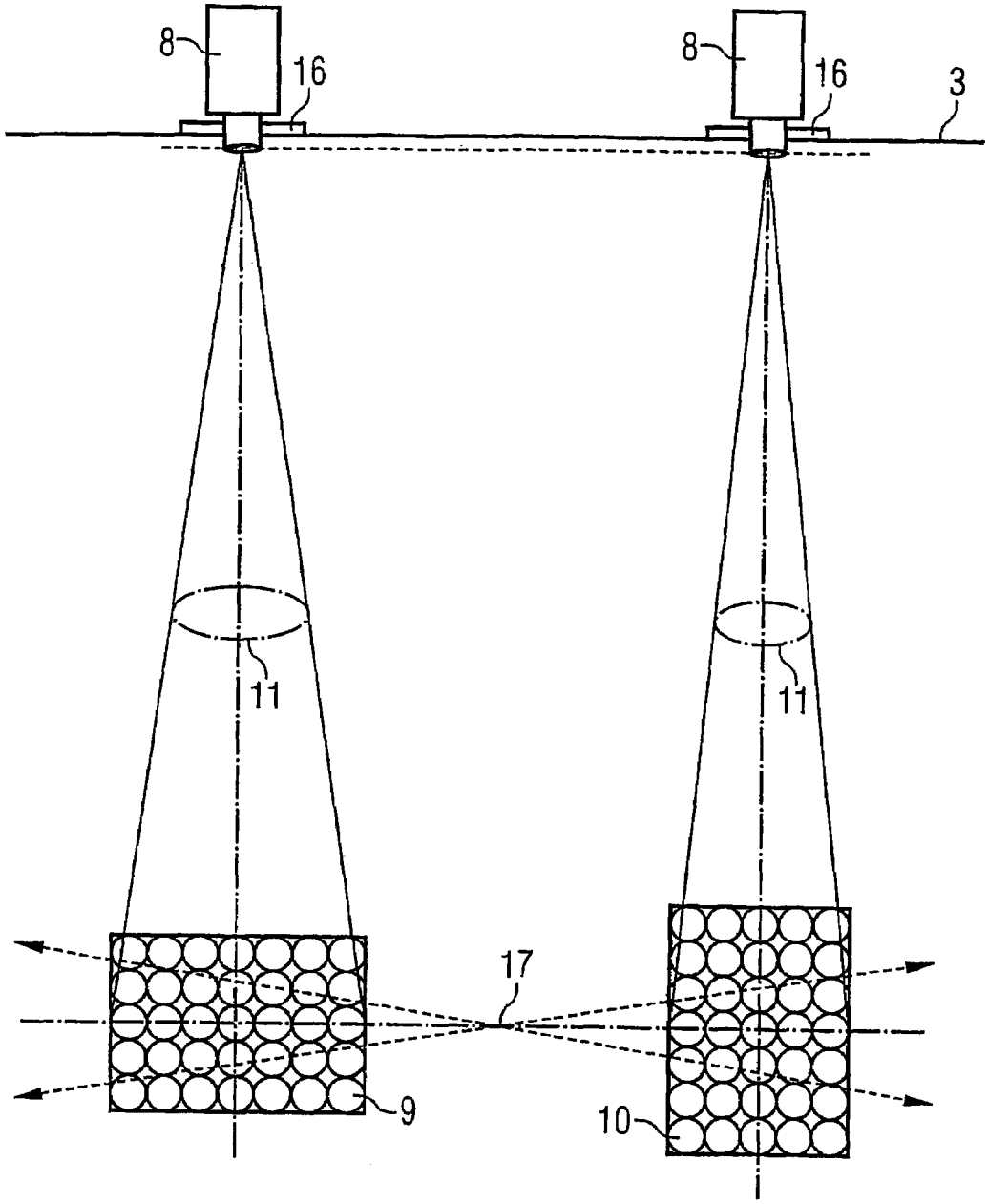
FIG 3 (PRIOR ART)
FIG. 3 shows a device with two cameras for capturing a rotary oscillation.

FIG. 2 shows a side view of another exemplary lifting gear, such as a gantry 36 for loading and unloading containers. The gantry 36 includes a trolley 3 and a hoist mechanism for lifting a load 24. Parts corresponding with those in FIG. 1 are denoted by identical reference numerals and will not be explained again. The description below will center on the differences between the embodiments. The hoist mechanism includes four lifting units 4, each equipped with a cable drum 5, whereby again only two of the four lifting units 4 are visible in FIG. 2. While FIG. 2 shows the gantry 36 movable along a rail 34 in a travel direction indicated by double arrow 35, it is, of course, also conceivable to construct a mobility of the gantry 36 without rails. As the trolley 3 and/or the gantry 36 travel and as the load 24 or the load-carrying member 23 is lifted and lowered in lifting direction 21, also the gantry 36 may encounter a rotation of the load 24 and/or the load-carrying member 23, e.g. rotation (skew). The gantry 36 is equipped with a camera 8 secured in the area of the trolley 3 for determining the load position and thus this rotary oscillation.

Figure 4:
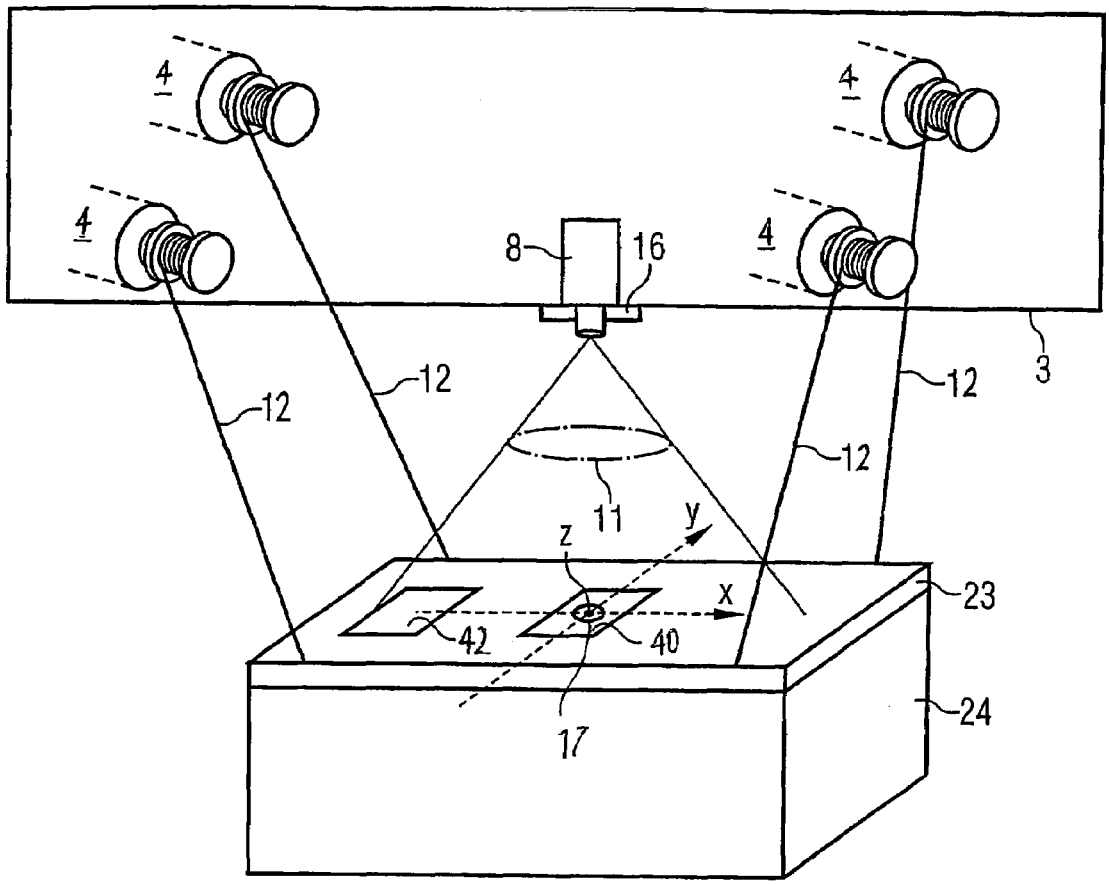
FIG. 4 illustrates suspension of a load with two markers and positioning of a camera.

Turning now to FIG. 4, there is shown a schematic perspective illustration of a position determining system according to the present invention for application in the crane 1 or gantry 36. The load-carrying member 23 is suspended from the trolley 3 via cables 12, with the load 24 suspended from the load-carrying member 23. The length of the cables 12 can be changed by the associated lifting units 4. The camera 8 records the load 24 and the load-carrying member 23 in an image field 11 that expands towards the load 24. Two markers 40, 42 are provided on the load-carrying member 23 and can be recognized from the image recorded by the camera 8 by means of an image processing device. Marker 40 is hereby located on the rotation axis of the load 24, whereas marker 42 is located at a distance to the rotation axis. The image field 11 is greater than a size of the markers 40, 42. Advantageously, only those regions of the image field 11 are processed that include the feature necessary to determine the position of the load. The load 24 has a center of mass 17 which is shown here in coincidence with the z-axis. This coincidence is however not required and is merely done for ease of understanding. Further indicated in FIG. 4 are the x-axis and the y-axis which extend perpendicular to the z-axis.

Figure 5:
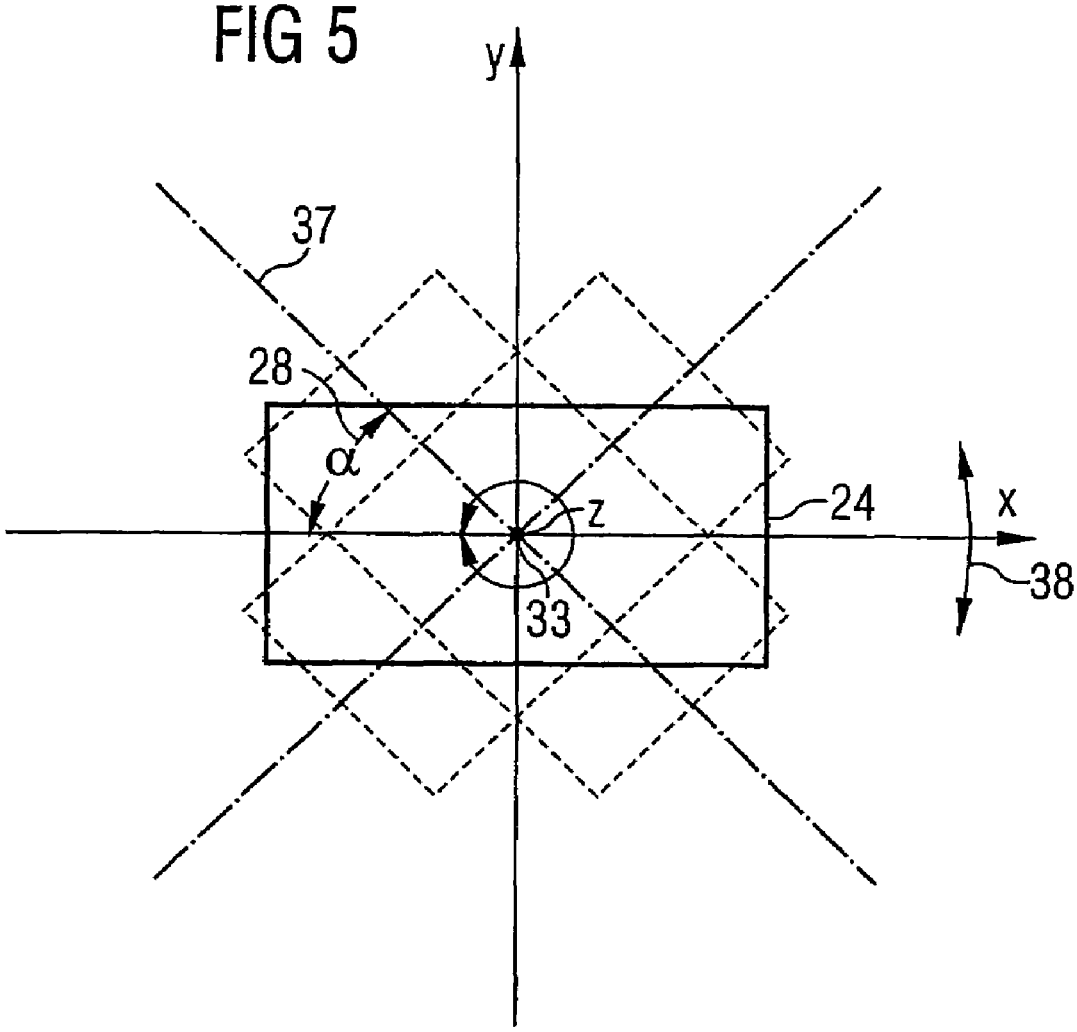
FIG. 5 shows a rotary oscillation of a load.

FIG. 5 depicts an exaggerated rotary oscillation about a rotation point 33 which coincides with the z-axis and thus, e.g., with the center of mass 17. The angle $\alpha$ between the x-axis and a centerline 37 through the load 24 defines the rotation angle, i.e., the skew angle 28. The rotation motion about the z-axis is indicated by the curved double arrow 38.

Figure 6:
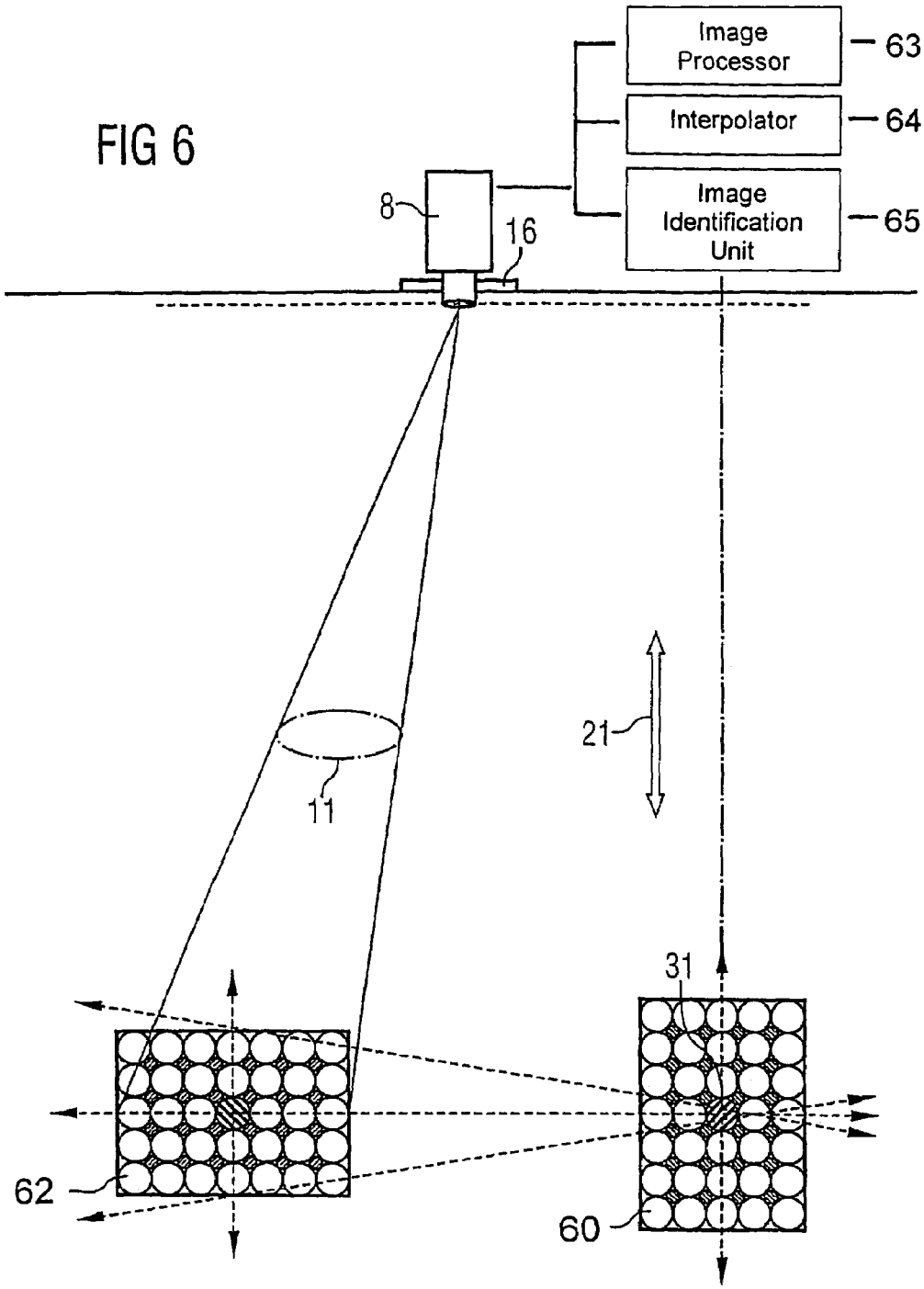
FIG. 6 shows a device with a single camera for capturing a rotary oscillation.

FIG. 6 shows a schematic illustration of the position determination system according to the present invention, having two markers 60 and 62, and a single camera 8. The marker 60 is located in an area of a rotation axis 31 of a rotary oscillation, with the rotation axis 31 oriented along the lifting direction 21. As a consequence, the position of the marker 60 is determined less frequently than the position of the second marker 62 during evaluation of an image field of the camera 8. In FIG. 6, the image field 11 is directed towards the marker 62, the position of which is determined by an image processor 63, whereas the position of the marker 60 can be interpolated using an interpolator 64 which is operatively connected to the camera 8 for data transfer. A rotary oscillation of the load which has attached thereto the markers 60, 62 can be determined from the position of the two markers 60, 62. The accuracy with which a rotary oscillation about the rotation axis 31 can be compensated increases with a smaller cycle time, which can be in the range of milliseconds. Because a virtual position of a marker 60 is now available for identifying the position of the load during a rotary oscillation, with only the position of a single marker 62 to be determined by an image identification unit 65 linked by data connection to the camera 8, a greater number of successive positions can be determined. It will be understood that the virtual position of the marker 60 should be corrected from time to time to match the actual position of that marker by aiming the image field 11 at least toward the marker 60 and optionally at the same time also toward the marker 62. Simultaneous evaluation of the position of two markers 60 and 62 during image processing may, of course, increase the processing time relative to the processing time for only one marker. This additional time is at least partially reduced by using a virtual center of mass position on the rotation axis 31 and by interpolating the position of the corresponding marker 60. It is noteworthy that the camera 8 determines the position of the market 62 more frequently than the position of the marker 30, because the position of marker 60 changes less during the rotation. For example, the position of the marker 60 can be corrected after every ten position determinations for the marker 62. The skew angle can be determined, for example, from the virtual position of the marker 60 and the actual position of the marker 62.

The present invention has several advantages. On one hand, a second camera is not needed. On the other hand, a lifting gear which already has a camera can be upgraded so as to also capture a rotary oscillation about an axis parallel to the lifting direction, for example by applying a second marker to the load 24 or the load-carrying member 23. The operational safety of the lifting gear can be increased by providing the two markers 62, 60 with additional active light sources that transmit, for example, a short light pulse (strobe). The active light source can be triggered by a first strobe coming from the direction of the camera and emitted, for example, by a strobe light 16 mounted on or near the camera 8. Higher image acquisition rates are attainable by using a virtual position point in the region of the marker 60, which can reduce the measurement noise.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A method for determining a rotary oscillation of a load suspended from a lifting gear having a trolley equipped with a single camera, comprising the steps of:

applying at least two spaced-apart markers to the load, with a first one of the markers positioned on an oscillation axis extending in a lifting direction;

orienting the camera in a direction toward the load and recording with the camera a position of the first marker with a first recording frequency;

recording with the camera with a second recording frequency which is grater than the first recording frequency a second one of the markers which is not located on the oscillation axis to thereby determine a position of the second marker; and identifying the rotary oscillation of the load from the recorded positions of the first and second markers.

2. The method of claim 1, further comprising the step of computing a skew angle or a position of the load, or both.

3. The method of claim 1, further comprising the step of interpolating the position of the first marker located in the oscillation axis during a time that two recordings are taken by the camera of the second marker.

4. The method of claim 1, further comprising the steps of recording with the camera a first image of the at least two markers and identifying of the at least two markers in the first image a position of the first marker located in the axis of oscillation; and recording with the camera a second image of the at least two markers; and evaluating in the second image the position of another of the at least two markers that is not located in the axis of oscillation.

5. The method of claim 1, further comprising the steps of recording with the camera at least two first images of the at least two markers and identifying of the at least two markers in the recorded images a position of the first marker located in the axis of oscillation; and recording with the camera a second image of another of the at least two markers that is not located in the axis of oscillation at least twice as frequently as the first images.

6. The method of claim 4, wherein the second image is recorded at least ten times as frequently as the first image.

7. A device for determining a oscillation about an oscillation axis of a load suspended from a lifting gear, comprising:

a single camera recording positions of at least two markers attached to a load, with one of the markers located on the oscillation axis which extends in a lifting direction of the load; and an interpolator receiving image data from the camera and determining the oscillation of the load from interpolated position data of the one marker located on the oscillation axis recorded at a first recording rate and from actual position data of another of the at least two markers not located in the oscillation axis recorded at a second recording rate greater than the first recording rate.

8. The device of claim 7, wherein the camera is attached to a trolley of the lifting gear, the device further including an image identification unit linked by data connection to the camera.

9. The device of claim 7, further comprising means for determining the oscillation axis of the load in the lifting direction.

10. The device of claim 7, wherein the at least two markers are implemented as an active light source or a passive light source, or both.

11. The device of claim 7, and further comprising an active light source directed from the trolley towards the at least two markers.

12. The device of claim 7, wherein the load represents a total load which includes a load-carrying member a useful load.

13. A method for determining a rotary oscillation of a load suspended from a lifting gear having a trolley equipped with a single camera that is adjustable to be aimed in a direction of the load, comprising the steps of:

recording with the camera images of at least two spaced-apart markers arranged on the load, with one of the markers being arranged approximately on an oscillation axis of the load, said oscillation axis being parallel to a lifting direction of the load, determining from the recorded images a center of oscillation on the one marker arranged approximately on the oscillation axis of the load, recording an image of another of the markers arranged at a location away from the oscillation axis and providing position data of that other marker, and adjusting at predetermined time intervals said determined center of oscillation on the one marker so as to coincide with an actual position of the center of oscillation of the one marker, wherein the image of the other of the markers is recorded more frequently than the center of oscillation on the one marker is adjusted.

* * * * *

UNITED STATES PATENT AND TRADEMARK OFFICE

CERTIFICATE OF CORRECTION

PATENT NO. : 7,331,477 B2
APPLICATION NO. : 11/093028
DATED : February 19, 2008
INVENTOR(S) : Peter Schulte et al.

It is certified that error appears in the above-identified patent and that said Letters Patent is hereby corrected as shown below:

Please correct the title of the invention to read:

On the Title page and Col. 1, line 1,

Item [54] --METHOD AND DEVICE FOR DETERMINING A ROTARY OSCILLATION OF A LOAD SUSPENDED FROM A LIFTING GEAR--

Signed and Sealed this

Seventeenth Day of June, 2008

JON W. DUDAS
*Director of the United States Patent and Trademark Office*